US006583103B1

(12) United States Patent
Klinkhammer

(10) Patent No.: US 6,583,103 B1
(45) Date of Patent: Jun. 24, 2003

(54) TWO PART CLEANING FORMULA RESULTING IN AN EFFERVESCENT LIQUID

(75) Inventor: Michael E. Klinkhammer, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 10/216,407

(22) Filed: Aug. 9, 2002

(65) Prior Publication Data

(65)

(51) Int. Cl.[7] ..... C11D 7/08; C11D 7/12

(52) U.S. Cl. ..... 510/478; 510/117; 510/191; 510/406; 510/477; 510/509

(58) Field of Search ..... 510/117, 191, 510/509, 477, 478, 406

(56) References Cited

U.S. PATENT DOCUMENTS

| | | | | |
|---|---|---|---|---|
| 3,032,240 | A | | 5/1962 | Dunklee |
| 3,105,615 | A | | 10/1963 | Koga |
| 3,341,418 | A | | 9/1967 | Moses |
| 3,708,431 | A | | 1/1973 | Prussin |
| 3,723,324 | A | | 3/1973 | Pierce |
| 3,729,553 | A | | 4/1973 | Gold et al. |
| 3,762,875 | A | | 10/1973 | Burmeister |
| 3,770,641 | A | | 11/1973 | Cantor |
| 3,866,800 | A | | 2/1975 | Schmitt |
| 4,002,571 | A | | 1/1977 | Anderle et al. |
| 4,272,393 | A | | 6/1981 | Gergely |
| 4,316,824 | A | | 2/1982 | Pancheri |
| 4,336,356 | A | | 6/1982 | Aharoni et al. |
| 4,337,318 | A | | 6/1982 | Doyle |
| 4,348,292 | A | | 9/1982 | Ginn |
| 4,401,490 | A | | 8/1983 | Alexander et al. |
| 4,417,993 | A | | 11/1983 | Gergely |
| 4,433,013 | A | | 2/1984 | Puhringer |
| 4,456,492 | A | | 6/1984 | Alexander et al. |
| 4,514,326 | A | | 4/1985 | Sallay |
| 4,522,738 | A | | 6/1985 | Magid et al. |
| 4,619,710 | A | | 10/1986 | Kuenn et al. |
| 4,666,625 | A | | 5/1987 | Shaer et al. |
| 4,679,706 | A | | 7/1987 | Magid et al. |
| 4,683,004 | A | | 7/1987 | Goddard |
| 4,683,008 | A | | 7/1987 | Betts |
| 4,707,441 | A | | 11/1987 | Ahmad et al. |
| 4,797,231 | A | | 1/1989 | Schumann et al. |
| 4,897,251 | A | | 1/1990 | Maurice et al. |
| 4,965,019 | A | | 10/1990 | Schmid et al. |
| 4,990,327 | A | | 2/1991 | Neirinckx |
| 5,004,591 | A | | 4/1991 | Maurice et al. |
| 5,141,666 | A | | 8/1992 | Yorozu et al. |
| 5,154,917 | A | | 10/1992 | Ibrahim et al. |
| 5,198,144 | A | | 3/1993 | Ichii et al. |
| 5,264,146 | A | | 11/1993 | Tobiason |
| 5,286,402 | A | | 2/1994 | Geke et al. |
| 5,307,954 | A | | 5/1994 | Gick et al. |
| 5,392,947 | A | | 2/1995 | Gentile |
| 5,407,595 | A | | 4/1995 | Kamiya |
| 5,455,035 | A | | 10/1995 | Guerrero et al. |
| 5,562,856 | A | | 10/1996 | Jeschke et al. |
| 5,578,562 | A | | 11/1996 | Lockhart |
| 5,579,957 | A | | 12/1996 | Gentile et al. |
| 5,613,623 | A | | 3/1997 | Hildebrandt |
| 5,624,465 | A | | 4/1997 | Harris |
| 5,630,883 | A | | 5/1997 | Steer et al. |
| 5,665,427 | A | | 9/1997 | Horne et al. |
| 5,683,976 | A | | 11/1997 | Colurciello et al. |
| 5,718,729 | A | * | 2/1998 | Harris ..... 8/137 |
| 5,747,439 | A | | 5/1998 | Dunn et al. |
| 5,767,055 | A | | 6/1998 | Choy et al. |
| 5,770,554 | A | | 6/1998 | Misselyn et al. |
| 5,776,877 | A | | 7/1998 | Peterson et al. |
| 5,797,986 | A | | 8/1998 | Rolando et al. |
| 5,804,546 | A | * | 9/1998 | Hall ..... 510/406 |
| 5,862,949 | A | | 1/1999 | Markey et al. |
| 5,865,345 | A | | 2/1999 | Cistone et al. |
| 5,885,949 | A | | 3/1999 | Stamm |
| 5,931,172 | A | | 8/1999 | Steer et al. |
| 5,948,792 | A | | 9/1999 | Tsuchiya et al. |
| 5,958,454 | A | | 9/1999 | Schrempf et al. |
| 5,962,393 | A | | 10/1999 | Blum et al. |
| 5,968,453 | A | | 10/1999 | Shugart |
| 5,975,335 | A | | 11/1999 | Witenhafer |
| 6,065,643 | A | | 5/2000 | Harvey et al. |
| 6,126,697 | A | | 10/2000 | Ebberts |
| 6,127,330 | A | | 10/2000 | Bonett |
| 6,136,768 | A | | 10/2000 | Dawson et al. |
| 6,177,092 | B1 | * | 1/2001 | Lentini et al. ..... 424/401 |
| 6,223,942 | B1 | | 5/2001 | Markey et al. |
| 6,245,157 | B1 | | 6/2001 | Gerlach et al. |
| 6,273,960 | B1 | | 8/2001 | Bhatia et al. |
| 6,290,872 | B1 | | 9/2001 | Fourcot et al. |
| 6,302,969 | B2 | | 10/2001 | Moster et al. |
| 6,313,086 | B1 | | 11/2001 | Askew et al. |

FOREIGN PATENT DOCUMENTS

| | | | |
|---|---|---|---|
| EP | 733097 | * | 10/1988 |
| EP | 733097 | | 10/1998 |
| EP | 1153881 | | 11/2001 |
| WO | WO 98/33880 | | 8/1998 |
| WO | 98/33880 | * | 8/1998 |
| WO | WO 01/00765 | | 1/2001 |
| WO | WO 02/22467 | | 3/2002 |

* cited by examiner

*Primary Examiner*—Charles Boyer

(57) ABSTRACT

A liquid two part cleaning composition for hard surfaces, and a two chamber bottle for dispensing the cleaner are disclosed. The cleaner includes a first basic liquid and a second acidic liquid. At least one of the liquids includes a surfactant system. At least one of the liquids includes a foam inhibitor. When the first and second liquid are dispensed on a surface, carbon dioxide gas released instantaneously creates a quickly breaking foam on the surface. The bottle has horizontal orientation, of the first and second chamber that assures a user's thumb is on the front wall and a user's fingers are on the rear wall of the bottle when dispensing. The horizontal orientation provides an ergonomically advantageous wide range of motion. The positioning of a user's thumb on the front wall of the bottle allows for design adjustments in the bottle to achieve equal dispensing from both chambers.

39 Claims, 5 Drawing Sheets

TWO PART CLEANING FORMULA RESULTING IN AN EFFERVESCENT LIQUID

CROSS-REFERENCES TO RELATED APPLICATIONS

Not Applicable.

STATEMENT REGARDING FEDERALLY SPONSORED RESEARCH

Not Applicable.

BACKGROUND OF THE INVENTION

1. Field of the Invention

This invention relates to a liquid two part cleaning composition.

2. Description of the Related Art

Two part cleaning systems are available in which an acidic component and a basic component are kept physically separated until use and are mixed upon use to create a foaming or effervescent cleaning mixture.

For example, PCT International Application WO 01/00765 describes an aqueous liquid detergent composition that is prepared and delivered from a dual-compartment container. The first compartment may contain a basic effervescent agent (e.g., sodium bicarbonate) and the second compartment may contain an acidic effervescent agent (e.g., citric acid) The composition may contain other adjunct cleaning materials such as surfactants, suds suppressors, dyes, perfumes, and hydrotropes.

WO 98/33880 describes a two part foaming drain cleaner in which one part may have an acid and another part may have a base.

U.S. Pat. No. 5,804,546 discloses a two component shower gel having an acidic component and an alkali component. The acidic component may comprise citric acid, a thickener and water. The alkali component may comprise sodium bicarbonate, an anionic surfactant, an amphoteric surfactant, and a non-ionic surfactant. The acid and the alkali components are charged into separate compartments within a flexible container. When the container is compressed the contents of both compartments are dispensed through a nozzle whereby a reaction between the acid and the bicarbonate occurs releasing carbon dioxide gas which in turn creates a foam.

U.S. Pat. No. 4,522,738 discloses a toilet bowl cleaner wherein a dry mixture of an acidic material (e.g., oxalic, citric, sulfamic, tartaric and glutaric acids), a basic material (e.g., mixtures of sodium carbonate and sodium bicarbonate) and a surfactant react with water to foam and clean the toilet bowl.

EP 0 733 097 B1 discloses a two part liquid cleaning composition that may be used to clean hard surfaces such as ceramic tile. The two part cleaner may include a composition A having a thickener, a metal complexing agent, hydrogen peroxide, disodium hydrogen citrate, a non-ionic surfactant and perfume; and composition B having a polymeric thickener, sodium hydroxide, non-ionic surfactant, cationic surfactant and a solvent.

U.S. Pat. No. 5,154,917 discloses a two component mouth rinse including a red liquid and a blue liquid that are filled into the compartments of the two compartment bottle. The red (basic) liquid may include sodium bicarbonate, ethanol, and non-ionic surfactant. The blue (acidic) liquid may include citric acid. Upon mixing, the mixture effervesces.

The six references mentioned above show some examples of the wide number of uses that have been proposed for such two part cleaning systems. Often, two part cleaning systems are well suited for certain uses but are completely unsatisfactory for other uses. For example, a two part cleaning system used as a shower gel will usually provide high foaming characteristics such that the two part cleaning system is unacceptable for use in a low foaming liquid detergent intended for automatic clothes washers or dishwashers. Also, high foaming two part cleaners may not provide for optimum cleaning as the mechanical cleaning potential available from the gas generated during the chemical reaction may be lost to foam generation. Low foaming two part cleaners may also have drawbacks. For instance, low foaming compositions may not have a level of surfactant necessary to solubilize all of the components desired in a composition. In particular, certain fragrances may not solubilize in a solution when low levels of surfactants are present. As a result, the air freshening capabilities of the two part cleaner are not optimized.

Various two compartment containers are available for dispensing two part cleaning systems as described above. Some example two compartment containers can be found in U.S. Pat. Nos. 6,223,942, 5,954,213, and 5,862,949, PCT International Publication Number WO 02/22467 A1 and European Patent Application No. EP 1 153 881 A1. While most two compartment containers can be used to dispense liquid two part cleaning systems, two compartment containers typically do not provide for controlled/even dispensing of both liquids from the two compartments. For instance, one problem with a two-compartment bottle is ensuring that the contents of both compartments run out at the same time. Even dispensing is particularly important with reactive two part chemistry. With two liquids that work together, if one liquid runs out first, then the benefit of having a two part formula is lost. In addition, consumers may react unfavorably to having to waste the portion of the second liquid that remains after the first liquid has been used up.

Known two compartment containers also do not provide for optimum ergonomics. Often, the arrangement of the two compartments and the associated dispensing nozzles makes it difficult to dispense the two liquids to all locations of a surface being cleaned. For example, a user may be required to change the position of the container in the hand when dispensing, and also may be required to change hands when dispensing. These difficulties in dispensing from known two compartment bottles may limit consumer acceptance of the containers.

Thus, there is a continuing need for an improved two part cleaning composition having foaming characteristics that do not limit the beneficial mechanical cleaning action of the chemical reaction of the two part cleaner. Also, there is a continuing need for a two part cleaning composition having an improved balance of foaming characteristics and air freshening characteristics such that the cleaner is advantageous in cleaning the hard surfaces in a kitchen or bathroom (e.g., vanity, toilet, bathtub, countertop, shower, sinks).

SUMMARY OF THE INVENTION

The foregoing needs are met by a two part cleaning composition including (i) a first aqueous liquid comprising a base selected from the group consisting of carbonates, bicarbonates, sesquicarbonates, and mixtures thereof, and (ii) a second aqueous liquid comprising an acid. At least one of the liquids includes about 0.001 percent by weight to about 4 percent by weight of a surfactant system. At least one of the liquids includes about 0.001 percent by weight to about 3 percent by weight of a foam inhibitor. In another embodiment, at least one of the liquids includes about 0.001 percent by weight to about 1 percent by weight of a silicone foam inhibitor. In yet another embodiment, at least one of the liquids includes about 0.001 percent by weight to about 1 percent by weight of a fragrance comprising at least one oil.

When the first liquid and the second liquid are dispensed on a surface such as a toilet bowl, the first liquid and the second liquid mix thereby initiating a chemical reaction between the base and the acid. Carbon dioxide gas released from the base instantaneously creates a foam in the mixture. The foam inhibitor then quickly breaks the foam, and the remaining gas generated creates a physical/mechanical cleaning action in the mixture (rather than excess foaming) and produces noise when bubbles in the mixture break. The gas generation also promotes to release of fragrance into the air (rather than excess foaming) thereby freshening the air in the vicinity of the surface being cleaned.

The first liquid and the second liquid of the two part cleaner are kept physically separated until use, preferably in a bottle as described herein. A bottle as described herein includes a first chamber for the first liquid and a second chamber for the second liquid. The first chamber has a lower section and an upper section. The lower section of the first chamber has an inner mating wall and an exterior wall, and the upper section of the first chamber has an inner wall, an exterior wall and a first exit opening. The second chamber has a lower section and an upper section. The lower section of the second chamber has an inner mating wall and an exterior wall, and the upper section of the second chamber has an inner wall, an exterior wall and a second exit opening. The first chamber and the second chamber are adjoined to each other at the inner mating wall of the first chamber and the inner mating wall of the second chamber thereby defining a front wall, side walls and a rear wall for the bottle.

In one form of a bottle as described herein, the front wall of the bottle includes at least a portion of the inner wall of the upper section of the first chamber, the rear wall of the bottle includes at least a portion of the inner wall of the upper section of the second chamber, and at least a portion of the inner mating wall of the first chamber and at least a portion of the inner mating wall of the second chamber extend between the side walls of the bottle. In another form of a bottle as described herein, a first axis of the first exit opening of the first chamber and a second axis of the second exit opening are tilted toward the front wall of the bottle.

These forms of the bottle provide a horizontal orientation of the first chamber and the second chamber that assures that a user's thumb is always on the front wall of bottle and a user's fingers are always on the rear wall of the bottle when dispensing the two part cleaner. The horizontal orientation provides an ergonomically advantageous greater range of motion for the user than a vertically oriented bottle provides. It has also been discovered that a user's thumb provides more pounds per square inch of pressure than do fingers which are spread out over a larger surface area. Thus, by forcing the thumb to always be positioned on the front wall of the bottle as described herein, adjustments can be made in the bottle design to compensate for the difference in thumb pressure and finger pressure and achieve equal dispensing from the bottle.

For instance, the surface area of the exterior wall of the lower section of the first chamber and the surface area of the exterior wall of the lower section of the second chamber can be varied to encompass a larger or smaller portion the front wall and the rear wall of the bottle and thereby provide for even dispensing. Another adjustment that can be made to compensate for the difference in thumb pressure and finger pressure and achieve equal dispensing is to provide for varying wall thicknesses in the first chamber and the second chamber. Still other modifications include having the first exit opening and the second exit opening have different transverse cross-sectional areas, using a first liquid and a second liquid with different viscosities, and using a first liquid and a second liquid having different specific gravities. Still further modifications include providing fluid paths between the first chamber and the first exit opening and the second chamber and the second exit opening that have varying transverse cross-sectional areas. For example, the fluid paths may taper inward from the first chamber to the first exit opening and from the second chamber to the second exit opening. Alternatively, the fluid paths may taper inward, then expand outward and then taper inward from the first chamber to the first exit opening and from the second chamber to the second exit opening.

It is therefore an advantage of the present invention to provide a two part cleaning composition having foaming characteristics that do not limit the beneficial mechanical cleaning action of the chemical reaction of the components of the two part cleaner.

It is another advantage of the present invention to provide a two part cleaning composition having an improved balance of foaming characteristics and air freshening characteristics such that the cleaner is advantageous in cleaning hard surfaces and freshening the air in the vicinity of the hard surfaces.

These and other features, aspects, and advantages of the present invention will become better understood upon consideration of the following detailed description, drawings, and appended claims.

BRIEF DESCRIPTION OF THE DRAWINGS

Like reference numerals will be used to refer to like or similar parts from Figure to Figure in the following description.

DETAILED DESCRIPTION OF THE INVENTION

Figure 1:
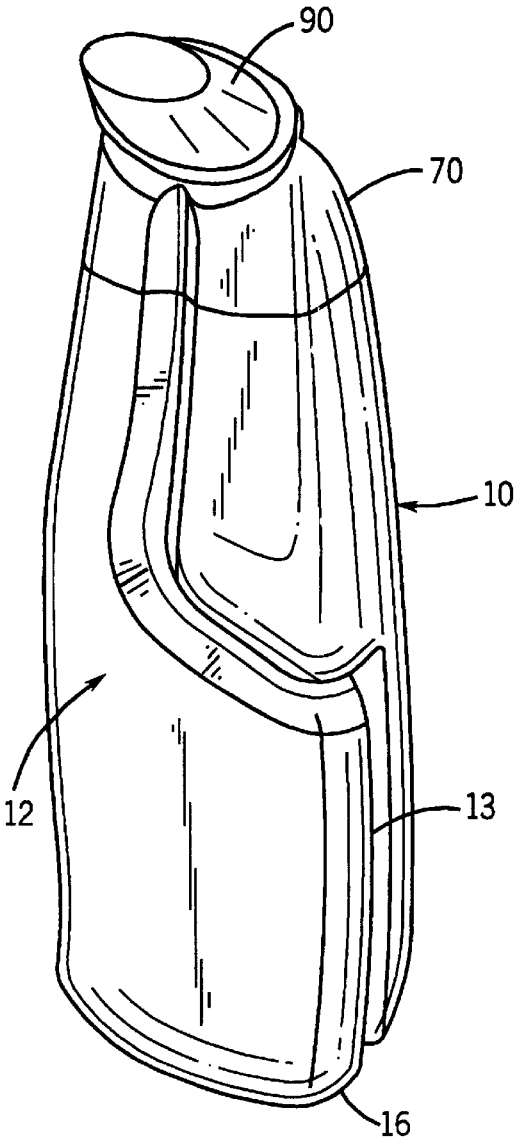
FIG. 1 shows a perspective view from the front of a bottle as described herein.
Figure 2:
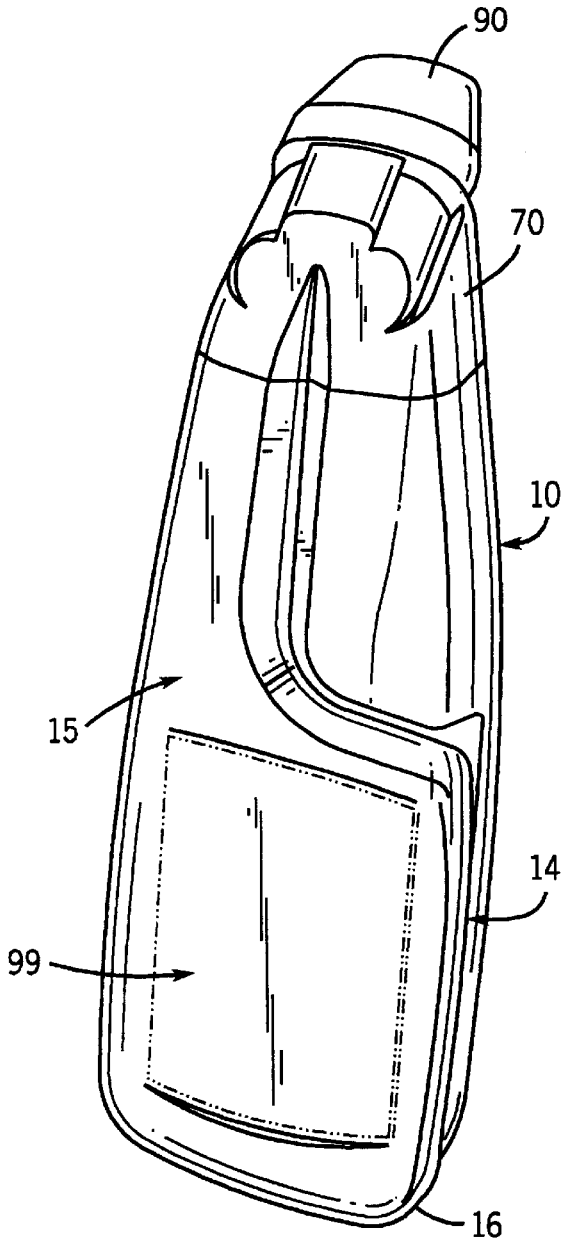
FIG. 2 shows a perspective view from the rear of the bottle of FIG. 1.

A two chamber bottle 10 as described hereinafter is used to hold and dispense a two part liquid cleaning composition according to the invention which is suitable for cleaning hard surfaces, such as tile, wash bowls, toilets, bathtubs, showers, sinks, countertops, walls and floors, particularly in kitchen and bathroom areas. In one embodiment, the two part cleaning composition is a liquid particularly useful for cleaning toilets and toilet bowls and includes: (i) a first aqueous liquid comprising a base selected from the group consisting of carbonates, bicarbonates, sesquicarbonates, and mixtures thereof, and (ii) a second aqueous liquid comprising an acid selected from the group consisting of sulfuric acid, hydrochloric acid, phosphoric acid, nitric acid, boric acid, formic acid, acetic acid, malic acid, maleic acid, succinic acid, tartaric acid, lactic acid, glutaric acid, glycolic acid, fumaric acid, benzoic acid, citric acid, sulfamic acid, oxalic acid, and mixtures thereof. The first liquid and the second liquid are kept physically separated (e.g., in first chamber 20 and in second chamber 40 of bottle 10) until dispensing. The first liquid may include about 0.001 percent by weight to about 4 percent by weight based on the total weight of the first liquid of a surfactant system which consists of all surfactants in the first liquid. The second liquid may include about 0.001 percent by weight to about 4 percent by weight based on the total weight of the second liquid of a surfactant system which consists of all surfactants in the second liquid. At least one of the first liquid and the second liquid includes a surfactant system at these levels. The first liquid may include about 0.001 percent by weight to about 3 percent by weight of a foam inhibitor, based on the total weight of the first liquid. The second liquid may include about 0.001 percent by weight to about 3 percent by weight of a foam inhibitor, based on the total weight of the second liquid. At least one of the first liquid and the second liquid includes a foam inhibitor at these levels.

In another embodiment, the two part cleaning composition includes: (i) a first liquid comprising a base selected from the group consisting of carbonates, bicarbonates, sesquicarbonates, and mixtures thereof, and (ii) a second liquid comprising an acid selected from the group consisting of sulfuric acid, hydrochloric acid, phosphoric acid, nitric acid, boric acid, formic acid, acetic acid, malic acid, maleic acid, succinic acid, tartaric acid, lactic acid, glutaric acid, glycolic acid, fumaric acid, benzoic acid, citric acid, sulfamic acid, oxalic acid, and mixtures thereof. The first liquid and the second liquid are kept physically separated (e.g., in first chamber 20 and in second chamber 40 of bottle 10) until dispensing. The first liquid may include about 0.001 percent by weight to about 4 percent by weight based on the total weight of the first liquid of a surfactant system which consists of all surfactants in the first liquid. The second liquid may include about 0.001 percent by weight to about 4 percent by weight based on the total weight of the second liquid of a surfactant system which consists of all surfactants in the second liquid. At least one of the first liquid and the second liquid includes a surfactant system at these levels. The first liquid may include about 0.001 percent by weight to about 1 percent by weight of a silicone foam inhibitor, based on the total weight of the first liquid. The second liquid may include about 0.001 percent by weight to about 1 percent by weight of a silicone foam inhibitor, based on the total weight of the second liquid. At least one of the first liquid and the second liquid includes a silicone foam inhibitor at these levels.

In yet another embodiment, the first liquid may also include about 0.001 percent by weight to about 1 percent by weight of a fragrance comprising at least one oil, based on the total weight of the first liquid. The second liquid may also include about 0.001 percent by weight to about 1 percent by weight of a fragrance comprising at least one oil, based on the total weight of the second liquid. At least one of the first liquid and the second liquid may also include a fragrance comprising at least one oil at these levels.

When the first liquid and the second liquid are dispensed on a surface such as a toilet bowl, the first liquid and the second liquid mix thereby initiating a chemical reaction between the base and the acid. Carbon dioxide gas released from the base instantaneously creates a foam in the mixture. The foam inhibitor then quickly breaks the foam, and the remaining gas generated creates a physical/mechanical cleaning action in the mixture and produces noise when bubbles in the mixture break. In embodiments including a fragrance, the gas generation also promotes the release of fragrance into the air thereby freshening the air in the vicinity of the surface being cleaned.

The amounts of the surfactant system, the foam inhibitor and the optional fragrance in the two part cleaning composition are one critical aspect of the invention. High levels of surfactant would create large volumes of a slowly breaking stable foam which would significantly limit the physical/mechanical cleaning action in the mixture of the two liquids. Thus, excess foam levels hinder cleaning performance. Large amounts of slowly breaking stable foam would also limit noise generation in the mixture of the two liquids thereby decreasing a user's audible cue that physical/mechanical cleaning action is occurring. Large amounts of slowly breaking foam would also limit the release of any fragrance into the air as gas generation would only serve to build foam and would not be used for fragrance release. However, at low levels of surfactant, a large enough portion of any fragrance oils would not be solubilized in the liquids such that excessive separation of the fragrance oils would occur. This would lead to uneven fragrancing with each use of the cleaner. Also, low levels of foam inhibitor fail to offset the foaming characteristics of the surfactant thereby creating large volumes of a slowly breaking foam and its associated problems. However, high levels of foam inhibitor would completely destroy foaming and the ability of the foamed cleaner to cling to surfaces. In addition, low levels of fragrance would lead to inadequate air freshening (when desired), while high levels of fragrance would make it difficult to solubilize a portion of the fragrance oils in the liquids.

The base in the first liquid comprises a base selected from the group consisting of carbonates, bicarbonates, sesquicarbonates, and mixtures thereof. Non-limiting examples of suitable bases include sodium carbonate, potassium carbonate, magnesium carbonate, calcium carbonate, ammonium carbonate, sodium bicarbonate, potassium bicarbonate, magnesium bicarbonate, calcium bicarbonate, ammonium bicarbonate, sodium sesquicarbonate, potassium sesquicarbonate, magnesium sesquicarbonate, calcium sesquicarbonate, ammonium sesquicarbonate, and mixtures thereof. Preferably, the base is selected from sodium carbonate, sodium bicarbonate and mixtures thereof, and is dissolved in water included in the first liquid. Most preferably, the base is a mixture of sodium carbonate and sodium bicarbonate wherein the sodium carbonate buffers decomposition of the sodium bicarbonate. Preferably, the first liquid comprises about 2 percent by weight to about 20 percent by weight of the base based on the total weight of the first liquid, and most preferably, the first liquid comprises about 2 percent by weight to about 10 percent by weight of the base based on the total weight of the first liquid.

The acid in the second liquid comprises an acid selected from the group consisting of sulfuric acid, hydrochloric acid, phosphoric acid, nitric acid, boric acid, formic acid, acetic acid, malic acid, maleic acid, succinic acid, tartaric acid, lactic acid, glutaric acid, glycolic acid, fumaric acid, benzoic acid, citric acid, sulfamic acid, oxalic acid, and mixtures thereof. Preferably, the acid is selected from citric acid, sulfamic acid, oxalic acid, and mixtures thereof, and most preferably, the acid is a mixture of citric acid, sulfamic acid, and oxalic acid. The acid is dissolved in water included in the second liquid. Preferably, the second liquid comprises about 5 percent by weight to about 25 percent by weight of the acid based on the total weight of the second liquid, and most preferably, the second liquid comprises about 10 percent by weight to about 20 percent by weight of the acid based on the total weight of the second liquid. In one preferred embodiment, the second liquid comprises about 2 percent by weight to about 10 percent by weight of citric acid based on the total weight of the second liquid, and about 5 percent by weight to about 15 percent by weight of sulfamic acid based on the total weight of the second liquid.

The surfactant system present in the first liquid and/or the second liquid may be a single surfactant or a mixture of surfactants. Anionic, nonionic, amphoteric, zwitterionic surfactants and mixtures thereof are suitable in the surfactant system of the present invention, and are present in an amount from about 0.001 percent by weight to about 4 percent by weight based on the total weight of the first liquid or the second liquid, and preferably, an amount from about 0.001 percent by weight to about 2 percent by weight based on the total weight of the first liquid or the second liquid. Anionic surfactants, nonionic surfactants and mixtures thereof are especially preferred.

Non-limiting examples of anionic surfactants include water-soluble alkyl or alkylaryl compounds, the alkyl having from about 8 to about 22 carbons, including a sulfate or sulfonate substituent group that has been base-neutralized, typically to provide an alkali metal (e.g., sodium or potassium) cation, including, for example: (1) alkyl and alkylaryl sulfates and sulfonates having preferably 8 to 18 carbons in the alkyl group, which may be straight or branched chain, e.g., sodium lauryl sulfate and sodium dodecylbenzene sulfonate; (2) alphaolefin aryl sulfonates preferably having from about 10 to 18 carbons in the olefin, e.g., sodium $C_{14-16}$ olefin sulfonate; and (3) alkyl ether sulfates such as sodium lauryl ether sulfate. Preferred anionic surfactants are the alkyl sulfates and the alkyl ether sulfates.

Non-limiting examples of non-ionic surfactants include (1) fatty alcohol alkoxylates, especially the ethoxylates, wherein the alkyl group has from 8 to 22, preferably 12 to 18, carbons, and typically 6 to 15 moles of alkoxide per molecule; (2) fatty acid alkoxylates having from about 6 to about 15 moles of alkoxylate, especially the ethoxylate; (3) alkylphenoxy alkoxylates, especially the ethoxylates, containing 6 to 12 carbons, preferably octyl or nonyl, in the alkyl, and having about 5 to 25, preferably 5 to 15 moles alkylene oxide per molecule; (4) condensates of ethylene oxide with a hydrophobic base formed by condensation of propylene oxide with propylene glycol; (5) condensates of ethylene oxide with an amine or amide; (6) fatty amine oxides; (7) alkylolamides; and (8) low cloud point nonionic surfactants including, for example, ethoxylated-propoxylated alcohols. Preferred nonionic surfactants are the fatty alcohol ethoxylates.

The foam inhibitor present in the first liquid and/or the second liquid may selected from the group consisting of silicone materials, fragrance oils, glycol ethers, and mixtures thereof. The foam inhibitor is present in an amount from about 0.001 percent by weight to about 3 percent by weight based on the total weight of the first liquid or the second liquid, preferably, in an amount from about 0.001 percent by weight to about 2 percent by weight based on the total weight of the first liquid or the second liquid, and most preferably, in an amount from about 0.001 percent by weight to about 1 percent by weight based on the total weight of the first liquid or the second liquid.

The foam inhibitor may be a silicone material present in the first liquid and/or the second liquid. The silicone material employed as the foam inhibitor can be an alkylated polysiloxane material wherein the side chain groups are alkyl, aryl, or mixed alkyl and aryl groups. Specific examples of such silicone materials include dimethyl polysiloxanes, diethyl polysiloxanes; dipropyl polysiloxanes; dibutyl polysiloxanes; methylethyl polysiloxanes; phenylmethyl polysiloxanes; and the like. The dimethyl polysiloxanes are particularly useful herein due to their low cost and ready availability. A second type of silicone foam inhibitor useful in the first liquid and/or the second liquid comprises a mixture of an alkylated siloxane of the type disclosed above and silica.

The foam inhibitor may be a fragrance oil present in the first liquid and/or the second liquid. Alternatively, the foam inhibition may come from the silicone materials and/or glycol ethers present in the first liquid and/or the second liquid. The fragrance present in the first liquid and/or the second liquid may comprise a single fragrance oil or a mixture including at least one fragrance oil. Any fragrance that does not significantly interfere with the cleaning properties of the composition is suitable, and the fragrance (if present for fragrancing purposes) is present in an amount from about 0.001 percent by weight to about 1 percent by weight based on the total weight of the first liquid or the second liquid, and preferably, in an amount from about 0.001 percent by weight to about 0.6 percent by weight based on the total weight of the first liquid or the second liquid. When the fragrance includes oils that act as a foam inhibitor, a portion of the fragrance oil is not solubilized in the first liquid or the second liquid such that the portion of fragrance oil that is not solubilized (typically in the form of droplets) can act as a foam inhibitor.

The foam inhibitor may be a glycol ether present in the first liquid and/or the second liquid. Non-limiting examples of foam inhibiting glycol ethers are represented by the formula $R_1$—O—$R_2$ wherein $R_1$ is a $C_1$–$C_8$ linear, branched or cyclic alkyl or alkenyl substituted with —OH and $R_2$ is a $C_1$–$C_8$ linear, branched or cyclic alkyl or alkenyl optionally substituted with —OH or —$OR_3$ wherein $R_3$ is a $C_1$–$C_8$ linear, branched or cyclic alkyl or alkenyl. Preferably, $R_1$ is selected from —$CH_2CH_2OH$, —$CH_2CHOHCH_3$ and —$CH_2CH_2CH_2OH$ and $R_2$ is a linear $C_1$–$C_8$ alkyl optionally substituted with —OH or —$OR_3$ wherein $R_3$ is a $C_1$–$C_8$ linear alkyl. More preferably, $R_1$ is selected from —$CH_2CHOHCH_3$ and —$CH_2CH_2CH_2OH$ and $R_2$ is a linear $C_1$–$C_8$ alkyl substituted with —$OR_3$ wherein $R_3$ is a $C_1$–$C_8$ linear alkyl. Suitable glycol ethers include ethylene glycol n-hexyl ether, ethylene glycol n-butyl ether, dipropylene glycol methyl ether, dipropylene glycol n-butyl ether, propylene glycol n-butyl ether and propylene glycol n-propyl ether. Preferred is dipropylene glycol n-butyl ether.

Organic solvents may also be present in the first liquid and/or the second liquid to enhance the cleaning efficiency of the two part composition of the invention. Such organic solvents are well known to those of ordinary skill in the art. Preferred solvents include lower alkanols such as ethanol. When present in the first liquid and/or the second liquid, the solvent is generally present in an amount from about 0.001 percent by weight to about 5 percent by weight based on the total weight of the first liquid or the second liquid, and preferably, in an amount from about 0.001 percent by weight to about 2 percent by weight based on the total weight of the first liquid or the second liquid.

A hydrotrope may also be present in the first liquid and/or the second liquid to assist in blending of surfactants and solvents (if present) and to raise the cloud point of the first liquid and/or the second liquid. Therefore, the amount of hydrotrope is dependent upon the concentration of the solvents and surfactant. Example hydrotropes are alkali metal salts of aromatic sulfonates. A preferred hydrotrope is sodium xylene sulfonate. Other exemplary hydrotropes include sodium butyl monoglycol sulfate, sodium toluene sulfonate and sodium cumene sulfonate. When present in the first liquid and/or the second liquid, the hydrotrope is generally present in an amount from about 0.001 percent by weight to about 5 percent by weight based on the total weight of the first liquid or the second liquid, and preferably, in an amount from about 0.001 percent-by weight to about 2 percent by weight based on the total weight of the first liquid or the second liquid.

A thickener may be used to increase the viscosity of the first liquid and/or the second liquid and thereby achieve the controlled even dispensing described above. However, any added thickener should not be present in so high an amount such that there is detraction from the cleaning action of the two part cleaning composition. The amount of the thickener will depend on the nature of the thickener and the other components in the two part composition, and it may be that the other components in the composition, in addition to the other properties, also act as the thickener for the purpose of giving the appropriate viscosity to the first liquid and the second liquid of the two part composition. For example, viscosities of 10–30 centipoise when measured with a Brookfield viscometer at 60 rpm with a #1 spindle at 25° C. are suitable. When present in the first liquid and/or the second liquid, the thickener is generally present in an amount from about 0.001 percent by weight to about 1 percent by weight based on the total weight of the first liquid or the second liquid. The thickener can be organic polymeric materials, inorganic compounds or mixtures thereof. Suitable organic polymeric thickeners are selected from at least one of a biopolymer, a cross-linked polyacrylate, and a modified polyacrylate, or mixtures thereof. The biopolymers can be xanthan or whelan gum. Suitable inorganic thickeners are selected from at least one of smectite clay, synthetic hectolite, alumino-silicate and attapulgite.

Foam stabilizers may also be used in the first liquid and/or the second liquid. Suitable foam stabilizers include cellulosic materials such as alkylcelluloses and hydroxyalkylcelluloses (e.g., hydroxy ethyl cellulose). When present in the first liquid and/or the second liquid, the foam stabilizer is generally present in an amount from about 0.001 percent by weight to about 1 percent by weight based on the total weight of the first liquid or the second liquid.

Dyes may also be used in the first liquid and/or the second liquid to achieve a desired hue, but without compromising the suitability of the product. When present in the first liquid and/or the second liquid, the dye is generally present in an amount from about 0.0001 percent by weight to about 1 percent by weight based on the total weight of the first liquid or the second liquid.

The first liquid and the second liquid of the cleaning composition of the invention are aqueous compositions. Water will usually comprise at least 60 percent, and preferably at least 80 percent by weight of the first liquid and the second liquid of the cleaning composition.

Looking at FIGS. 1 to 9, there is shown a two chamber bottle, indicated generally at 10, suitable for use with the cleaning composition of the invention. For ease of manufacture, the bottle 10 is assembled from four parts: a first chamber 20, a second chamber 40, an overcap 70 and a nozzle 80. However, these parts (in particular, the first chamber 20, the second chamber 40, and the overcap 70) may be molded as one piece if suitable tooling is prepared. A protective cap 90 is also provided for covering the nozzle 80 of the bottle 10 during shipping and storage.

All of the components of the bottle 10 and the cap 90 can be molded from a suitable thermoplastic material such as polyethylene and polypropylene, and any of the components may be pigmented as desired with conventional pigments suitable for plastic materials. In one embodiment, the first chamber 20 and the second chamber 40 are molded from high density polyethylene, the overcap 70 and cap 90 are molded from polypropylene, and the nozzle 80 is molded from polyethylene. In one embodiment, the walls of the first chamber 20 and the second chamber 40 are approximately 1 millimeter thick; however, in certain embodiments, the wall thickness may vary as described below. In one embodiment, the first chamber 20 and the second chamber 40 each have a filling level of about 375 milliliters and a brimful level of 400 milliliters.

Figure 3:
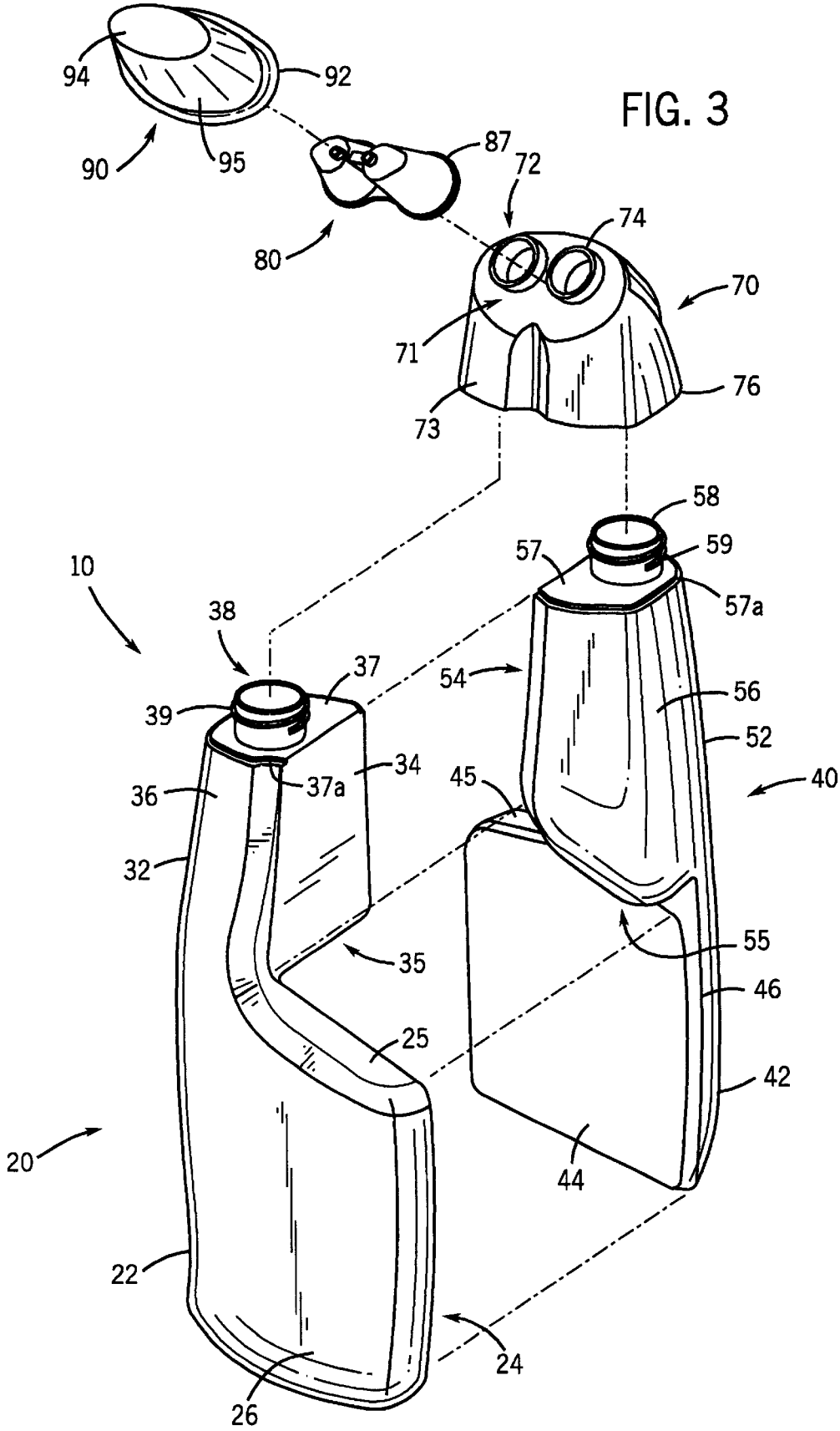
FIG. 3 shows a perspective exploded view of the bottle of FIG. 1.
Figure 4:
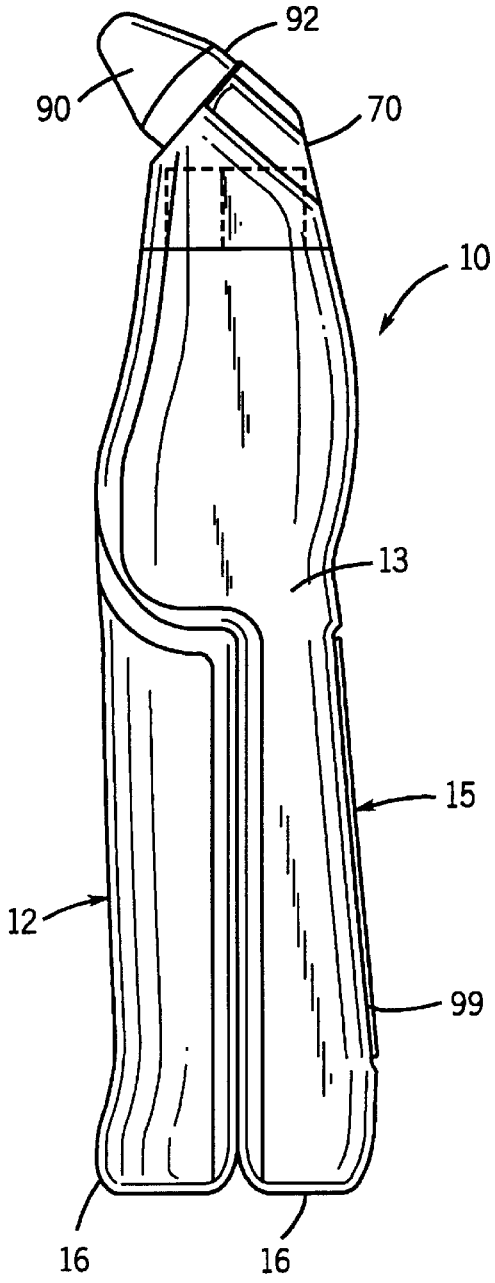
FIG. 4 shows a right side view of the bottle of FIG. 1.
Figure 5:
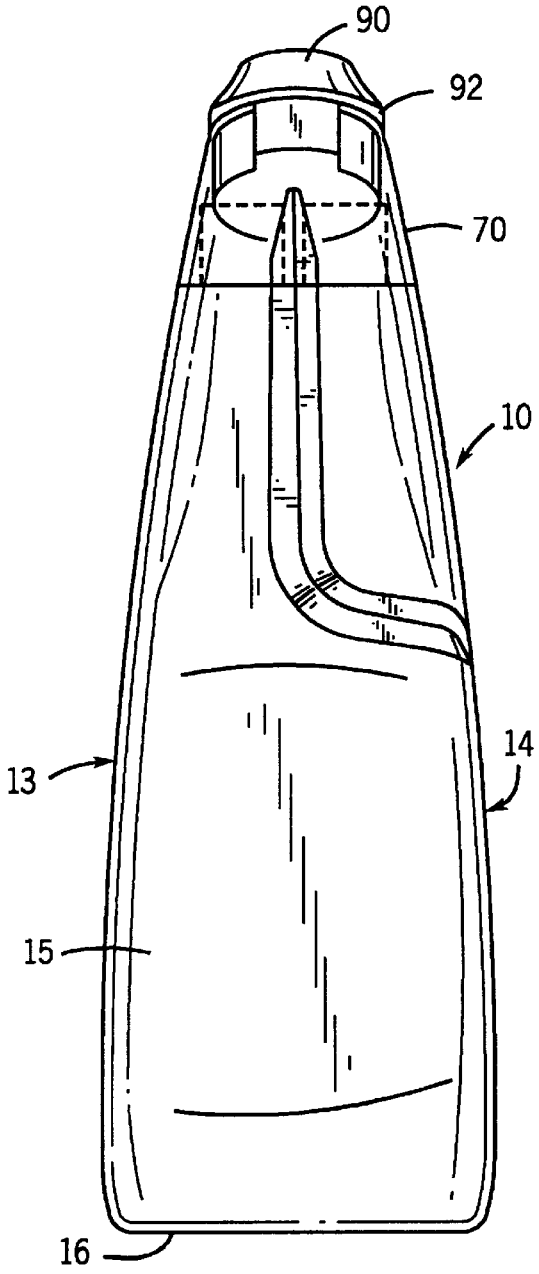
FIG. 5 shows a rear view of the bottle of FIG. 1.
Figure 6:
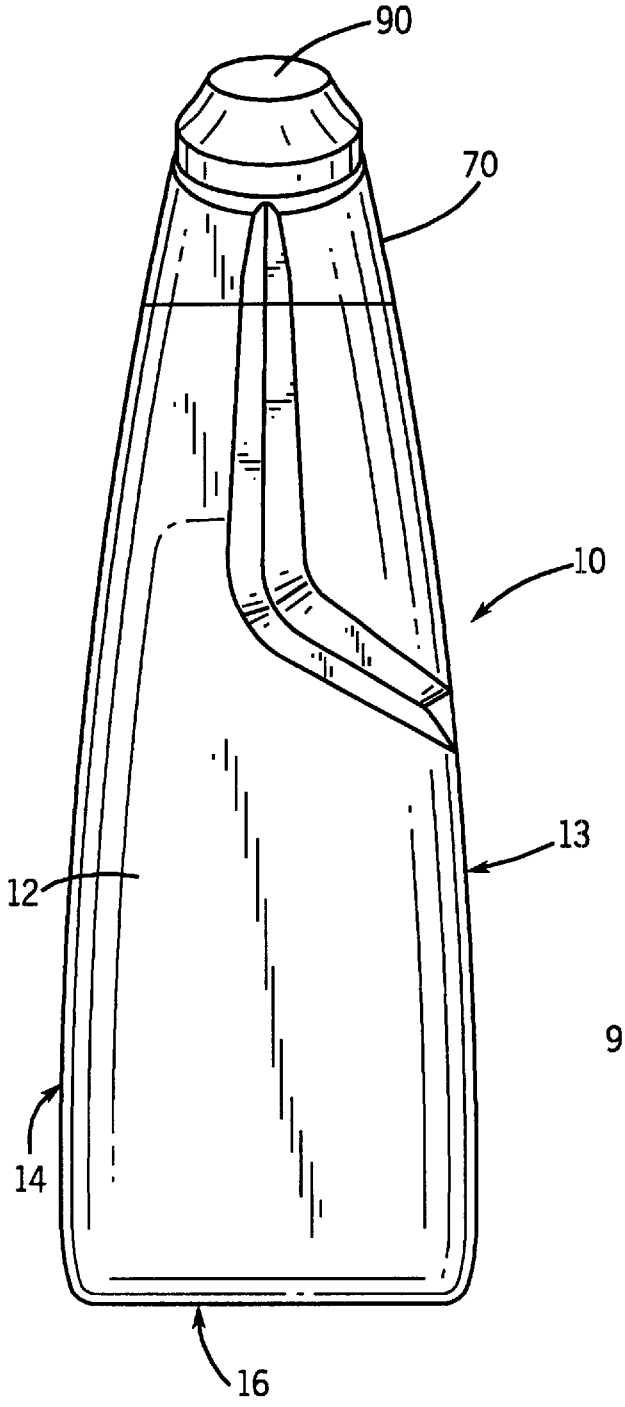
FIG. 6 shows a front view of the bottle of FIG. 1.

Referring specifically now to FIG. 3, the first chamber 20 includes a lower section 22 and an upper section 32. The lower section 22 of the first chamber 20 includes an inner mating wall 24, an upper wall 25 and an exterior wall 26. The upper section 32 of the first chamber 20 includes an inner wall 34, a lower wall 35, a top wall 37, and an exterior wall 36. The top wall 37 has a recessed area 37*a* on its perimeter and an upwardly extending cylindrical spout 38 with outwardly extending circumferential ribs 39. The first chamber 20 typically contains a first liquid, but is suitable for all flowable compositions. In the description below, a first liquid will be described for the purposes of illustration.

As used in this specification and accompanying claims, the term "flowable composition" includes liquids, solutions, suspensions, emulsions, gases and any other forms of matter referred to or known as a "liquid" or a "fluid", as well as other flowable compositions, such as powders (e.g., a carpet cleaning formula). The first and the second flowable compositions may be materials of the same physical character, or of different kinds. Each of the first and second flowable compositions may comprise liquids. However, the first flowable composition could take the form of a liquid, and the second flowable composition could (for example) take the form of a powder. Those of ordinary skill in the art will readily appreciate that many other combinations are possible, and are included within the scope of the present invention. Such persons would also readily appreciate that the flowable composition in either chamber could, prior to mixing with the flowable composition in the other chamber, also comprise a combination of two or more flowable compositions (e.g., an aerosol containing a gas and liquid).

The second chamber 40 includes a lower section 42 and an upper section 52. The lower section 42 of the second chamber 40 includes an inner mating wall 44, an upper wall 45 and an exterior wall 46. The upper section 52 of the second chamber 40 includes an inner wall 54, a lower wall 55, a top wall 57, and an exterior wall 56. The top wall 57 has a recessed area 57*a* on its perimeter and an upwardly extending cylindrical spout 58 with outwardly extending circumferential ribs 59. The second chamber 40 typically contains a second liquid, but is suitable for all flowable compositions as described above. In the description below, a second liquid will be described for the purposes of illustration.

The overcap 70 of the bottle 10 includes a top surface 71 and a skirt 73 extending downwardly from the top surface 71. The skirt 73 terminates in a lower edge 76. An annular upwardly extending first exit opening 72 and an annular upwardly extending second exit opening 74 are formed on the top surface 71 of the overcap 70.

Figure 8:
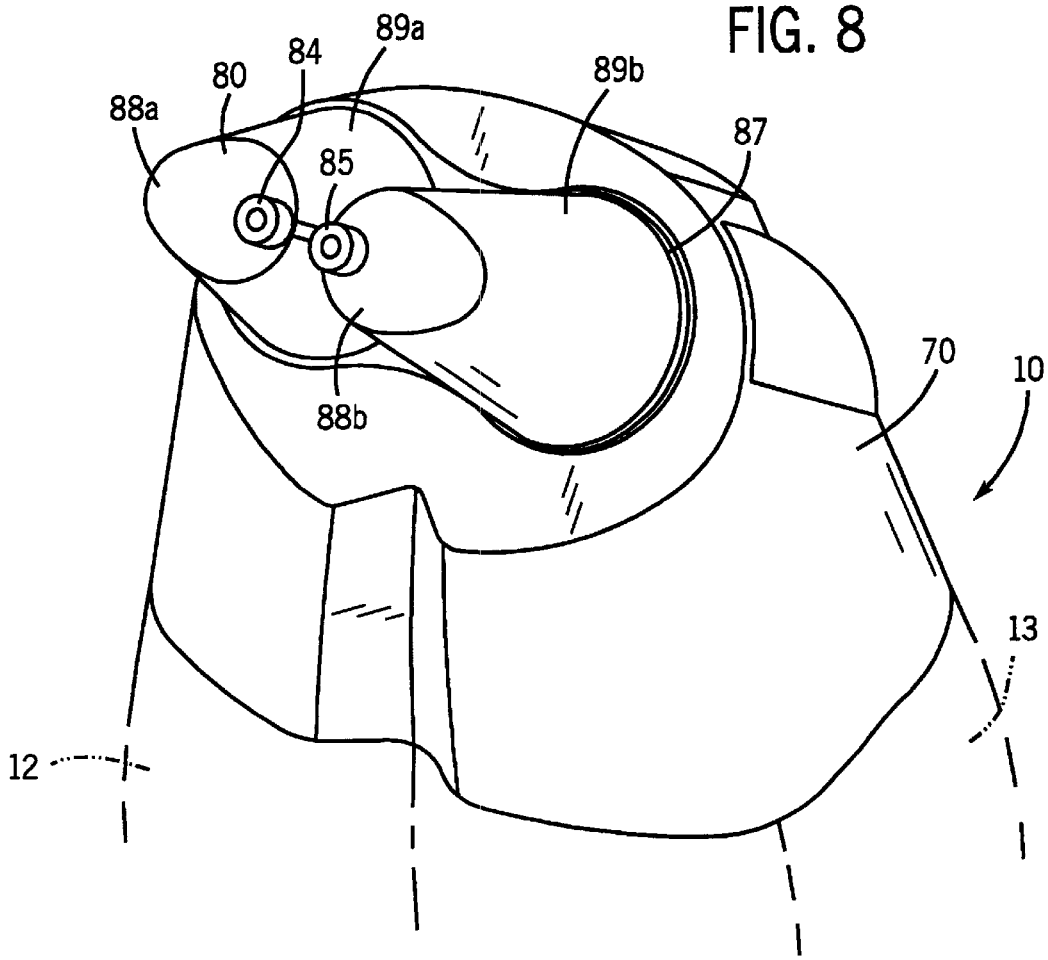
FIG. 8 shows a partial view of the top of the bottle of FIG. 1.
Figure 9:
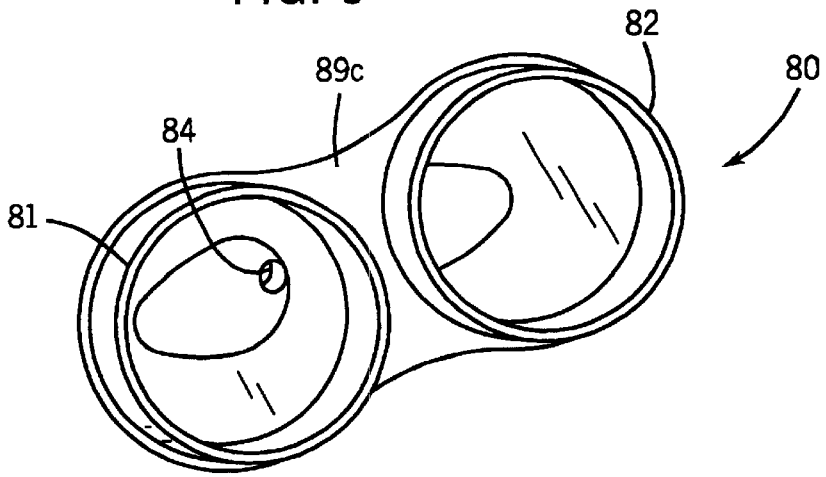
FIG. 9 shows a bottom view of the nozzle of the bottle of FIG. 1.

Referring now to FIGS. 8 and 9, the nozzle 80 of the bottle 10 includes a top surface 88*a* and a skirt 89*a* extending downwardly from the top surface 88*a,* and a top surface 88*b* and a skirt 89*b* extending downwardly from the top surface 88*b*. The skirts 89*a* and 89*b* are joined by a bridging section 89*c*. The skirt 89*a* terminates in an annular rim 81 at its bottom, and the skirt 89*b* terminates in an annular rim 82 at its bottom. A first annular orifice 84 extends upwardly from the top surface 88*a* of the nozzle 80, and a second orifice 85 extends upwardly from the top surface 88*b* of the nozzle 80. An outwardly extending raised area 87 is provided on the lower periphery of the nozzle 80.

The protective cap 90 includes a generally oval top surface 94 and a skirt 95 extending downwardly at an outward angle from the periphery of the top surface 94. The lower periphery of the skirt 95 has an outwardly extending section 92.

The assembly of the bottle 10 is best described with reference to FIG. 3. The first chamber 20, the second chamber 40, the overcap 70 and the nozzle 80 are all preferably manufactured from polyethylene or polypropylene and therefore, may be assembled together using conventional adhesives suitable for bonding polyethylene and polypropylene. Blends of adhesives, such as a blend of a fast curing adhesive and a slow curing adhesive, can be advantageous. Other means for assembling the components are also suitable such as friction welding, ultrasonic welding, snap fitting, and other conventional techniques. Those skilled in the art will contemplate other means for bringing chamber surfaces into contact or into adjoining relationship.

In the embodiment shown, the first chamber 20 and the second chamber 40 are adjoined to each other (using, for example, adhesive) at the inner mating wall 24 of the first chamber 20 and the inner mating wall 44 of the second chamber 20. Optionally, the inner mating wall 24 of the first chamber 20 and the inner mating wall 44 of the second chamber 20 may include means for aligning the first chamber 20 and the second chamber 40 during assembly such as a groove on the inner mating wall 24 of the first chamber 20 and a complementary outwardly extending rib on the inner mating wall 44 of the second chamber 20. When the first chamber 20 and the second chamber 40 are adjoined together, a front wall 12, side walls 13, 14, a rear wall 15 and a flat supporting surface 16 for the bottle 10 are defined as shown in FIGS. 1–2 and 4–5. Any of the walls of the bottle may include suitable labeling, such as label 99 on the rear wall 15 in FIG. 2.

When the first chamber 20 and the second chamber 40 are adjoined together, at least a portion of the inner wall 34 of the upper section 32 of the first chamber 20 and at least a portion of the inner wall 54 of the upper section 52 of the second chamber 40 adjoin each other, and preferably, the entire inner wall 34 of the upper section 32 of the first chamber 20 and the entire inner wall 54 of the upper section 52 of the second chamber 40 adjoin each other. Optionally, an adhesive may be used to create a bond between the inner wall 34 of the upper section 32 of the first chamber 20 and the inner wall 54 of the upper section 52 of the second chamber 40.

When the first chamber 20 and the second chamber 40 are adjoined together, at least a portion of the lower wall 35 of the upper section 32 of the first chamber 20 adjoins at least a portion of the upper wall 45 of the lower section 42 of the second chamber 40, and preferably, the entire lower wall 35 of the upper section 32 of the first chamber 20 adjoins the entire upper wall 45 of the lower section 42 of the second chamber 40. Optionally, the lower wall 35 of the upper section 32 of the first chamber 20 and the upper wall 45 of the lower section 42 of the second chamber 40 are adjoined together using an adhesive. Also, when the first chamber 20 and the second chamber 40 are adjoined together, at least a portion of the lower wall 55 of the upper section 52 of the second chamber 40 adjoins at least a portion of the upper wall 25 of the lower section 22 of the first chamber 20, and preferably, the entire lower wall 55 of the upper section 52 of the second chamber 40 adjoins the entire upper wall 25 of the lower section 22 of the first chamber 20. Optionally, the lower wall 55 of the upper section 52 of the second chamber 40 and the. upper wall 25 of the lower section 22 of the first chamber 20 are adjoined together using an adhesive. Looking at FIG. 3, it can be seen that the lower wall 35 of the upper section 32 of the first chamber 20 has a first shape complementary to the upper wall 45 of the lower section 42 of the second chamber 40, and the lower wall 55 of the upper section 52 of the second chamber 40 has a second shape complementary to the upper wall 25 of the lower section 22 of the first chamber 20. In the embodiment shown, the first shape and the second shape are different. The first shape and the second shape can be varied to provide for different flow rates from the first chamber 20 and the second chamber 40 and thereby provide for equal dispensing from the bottle 10.

After the first chamber 20 and the second chamber 40 are adjoined together, the overcap 70 is adjoined to the first chamber 20 and the second chamber 40. The lower edge 76 of the skirt 73 of the overcap 70 may be snap fit to the recessed area 37*a* of the top wall 37 of the first chamber 20 and to the recessed area 57*a* of the top wall 57 of the second chamber 40. Suitable adhesives can also be used if desired. When the overcap 70 is assembled to the first chamber 20 and the second chamber 40, the first exit opening 72 of the overcap 70 is placed in fluid communication with the upwardly extending cylindrical spout 38 of the first chamber 20 and the second exit opening 74 is placed in fluid communication with the upwardly extending cylindrical spout 58 of the second chamber 40. The spout 38 of the first chamber 20 and the spout 58 of the second chamber 40 may be arranged on an offset fashion as in FIG. 3 such that the overcap 70 can only be placed on the first chamber 20 and the second chamber 40 in one manner.

After the overcap 70 is assembled to the first chamber 20 and the second chamber 40, the nozzle 80 may then be assembled to the overcap 70. A snap fit between the annular rims 81, 82 at the bottom of the skirts 89*a*, 89*b* of the nozzle 80 and the first exit opening 72 and the second exit opening 74 respectively of the overcap 70 provides for a connection. Suitable adhesives can also be used, if desired. When the nozzle 80 is assembled to the overcap 70, the first exit opening 72 of the overcap 70 is placed in fluid communication with the first orifice 84 of the nozzle 80 and the second exit opening 74 of the overcap 70 is placed in fluid communication with the second orifice 85 of the nozzle 80. Those skilled in the art would readily appreciate that the nozzle 80 could be left out of the bottle construction, and dispensing could occur directly from the first exit opening 72 of the overcap 70 and the second exit opening 74 of the overcap 70.

The first orifice 84 and the second orifice 85 of the nozzle 80 can be configured to provide parallel streams of the first liquid and the second liquid. In one embodiment, the first orifice 84 and the second orifice 85 of the nozzle 80 are in the same plane or parallel planes and are spaced apart about 4 millimeters. In one form, the first orifice 84 and the second orifice 85 of the nozzle 80 do not share a common wall. Spacing between the first orifice 84 and the second orifice 85 of the nozzle 80 limits contamination between the first liquid and the second liquid before and during dispensing because the streams are parallel, and also assures that mixing of the first liquid and the second liquid occurs on the surface being cleaned; and not before application to the surface.

The fluid paths leading to the first orifice 84 and the second orifice 85 of the nozzle 80 can also be configured to provide streams of the first liquid and the second liquid that converge at a distance from the first orifice 84 and the second orifice 85 of the nozzle 80. For example, in one configuration, the first exit opening 72 of the overcap 70 and the first orifice 84 of the nozzle 80 are eccentric, and the second exit opening 74 of the overcap 70 and the second orifice 85 of the nozzle 80 are eccentric. In other words, the axis of the first exit opening 72 of the overcap 70 is not coaxial with the axis of the first orifice 84 of the nozzle 80, and the axis of the second exit opening 74 of the overcap 70 is not coaxial with the axis of the second orifice 85 of the nozzle 80. Also, the fluid paths leading to the first orifice 84 and the second orifice 85 of the nozzle 80 can be tapered. As a result of the eccentric orifices 84, 85 and exit openings 72,74 and/or tapering fluid paths, the streams of the first liquid and the second liquid may converge at a distance from the first orifice 84 and the second orifice 85 of the nozzle 80 even though the first orifice 84 and the second orifice 85 of the nozzle 80 are in the same or parallel planes.

Figure 7:
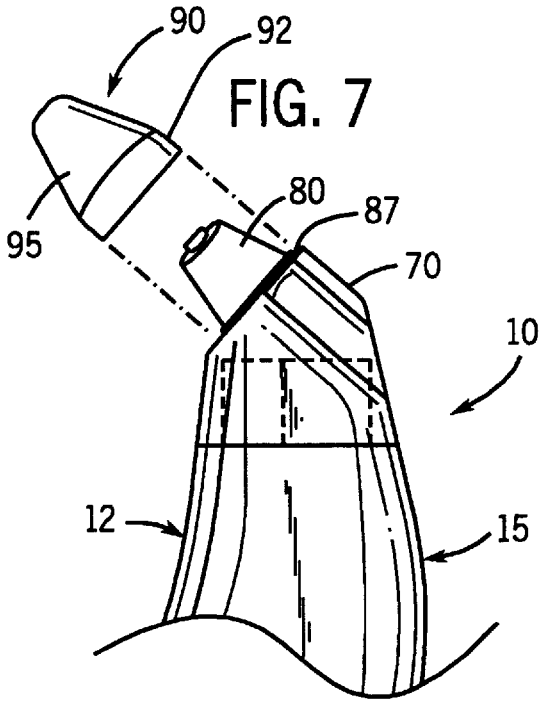
FIG. 7 shows a partial view of the top of the bottle of FIG. 1 with the cap being installed on the bottle.

The cap 90 is configured to be removable as shown in FIG. 7 and is held onto the nozzle 80 by way of a press fit between the outwardly extending raised area 87 provided on the lower periphery of the nozzle 80 and the outwardly extending section 92 of the skirt 95 of the cap 90. The cap 90 covers and seals the first orifice 84 and the second orifice 85 of the nozzle 80 of the bottle 10 during shipping and storage, and is removed when the first liquid and the second liquid are dispensed from the bottle 10.

The assembled bottle 10 has several very significant advantages. In particular, the bottle 10 has several structural relationships that provide for even dispensing of the first liquid from the first chamber 20 and the second liquid from the second chamber 40.

For example, the bottle 10 provides for a horizontal orientation of the first chamber 20 and the second chamber 40. Looking at the Figures, it can be seen that at least a portion of the inner wall 34 of the upper section 32 of the first chamber 20 extends from the front wall 12 to the rear wall 15 of the bottle 10, at least a portion of the inner wall 54 of the upper section 52 of the second chamber 40 extends from the front wall 12 to the rear wall 15 of the bottle 10, and at least a portion of the inner mating wall 24 of the first chamber 20 and at least a portion of the inner mating wall 44 of the second chamber 40 extend between the side walls 13, 14 of the bottle. Also, a first axis of the first exit opening 72 (and associated first orifice 84 of the nozzle 80) and a second axis of the second exit opening 74 (and associated second orifice 85 of the nozzle 80) are tilted toward the front wall 12 of the bottle 10. With this configuration, a user's thumb is always on the front wall 12 of bottle 10, and a user's fingers are always on the rear wall 15 of the bottle 10 when dispensing a product.

It has been discovered that a user's thumb provides more pounds per square inch of pressure than do fingers which are spread out over a larger surface area. Thus, by forcing the thumb to always be positioned on the front wall 12 of the bottle 10 as described herein, adjustments can be made to compensate for the difference in thumb pressure and finger pressure and achieve equal dispensing. For instance, the surface area of the exterior wall 26 of the lower section 22 of the first chamber 20 and the surface area of the exterior wall 46 of the lower section 42 of the second chamber 40 can be varied to encompass a larger or smaller portion the front wall 12 and the rear wall 15 of the bottle. For example, the portion of the exterior wall 26 of the lower section 22 of the first chamber 20 that comprises part of the front wall 12 of the bottle 10 may have at least one half of the surface area of the portion of the exterior wall 36 of the upper section 32 of the first chamber 20 that comprises part of the front wall 12 of the bottle 10 and the portion of the exterior wall 56 of the upper section 52 of the second chamber 40 that comprises part of the front wall 12 of the bottle 10 combined. Also, the portion of the exterior wall 46 of the lower section 42 of the second chamber 40 that comprises part of the rear wall 15 of the bottle 10 may have at least one half of the surface area of the portion of the exterior wall 56 of the upper section 52 of the second chamber 40 that comprises part of the rear wall 15 of the bottle 10 and the portion of the exterior wall 36 of the upper section 32 of the first chamber 20 that comprises part of the rear wall 15 of the bottle 10 combined. By varying the size of the exterior wall 26 of the lower section 22 of the first chamber 20 and the size of the exterior wall 46 of the lower section 42 of the second chamber 40 and by varying the ratio of sizes, equal dispensing can be achieved.

Another adjustment that can be made to compensate for the difference in thumb pressure and finger pressure and achieve equal dispensing is to provide for varying wall thicknesses in the first chamber and the second chamber. For instance, the first chamber may have a greater wall thickness than the second chamber in order to provide more resistance to a user's thumb than to a user's fingers when dispensing the two liquids.

The thumb-on-top orientation also allows for other modifications to account for the differential force between a user's thumb and a user's fingers. The modifications include: (1) having the first exit opening 72 (and/or associated first orifice 84 of the nozzle 80) and the second exit opening 74 (and/or associated second orifice 85 of the nozzle 80) have different transverse cross-sectional areas (i.e., larger opening size on the thumb side); (2) using a first liquid and a second liquid with different viscosities (i.e., a thicker formula on the thumb side); (3) using a first liquid and a second liquid having different specific gravities (i.e., less dense formula on the thumb side); (4) decreasing the transverse cross-sectional areas along the length of the fluid path from the first chamber to the first exit opening and/or along the length of the fluid path from the second chamber to the second exit opening (i.e., the fluid paths taper toward the exit openings); and (5) decreasing, increasing and then decreasing the transverse cross-sectional areas along the length of the fluid path from the first chamber to the first exit opening and/or along the length of the fluid path from the second chamber to the second exit opening (i.e., the fluid paths taper inward, then expand outward and then taper inward from the first chamber to the first exit opening and from the second chamber to the second exit opening). Modifications of the size of the first exit opening 72 (and/or associated first orifice 84 of the nozzle 80) and the second exit opening 74 (and/or associated second orifice 85 of the nozzle 80) can also provide for easier dispensing as larger openings tend to decrease back pressure on dispensing.

As detailed above, the horizontal orientation of the two chamber bottle when in use is also achieved by the configuration of the first exit opening 72 and the second exit opening 74. The first axis of the first exit opening 72 forms less than a 90 degree angle in relation to the flat supporting surface 16 of the bottle 10 and the second axis of the second exit opening 74 also forms less than a 90 degree angle in relation to the flat supporting surface 16 of the bottle 10. Further, the first axis of the first exit opening 72 and the second axis of the second exit opening 74 are tilted toward the front wall 12 of the bottle 10. In addition, an imaginary line extending from the first axis of the first exit opening 72 to the second axis of the second exit opening 74 forms an angle of less than 90 degrees with the inner mating wall 24 of the first chamber 20. In other words, the first exit opening 72 is arranged in a side by side relationship with the second exit opening 74 when the bottle 10 is viewed from the front. The first exit opening 72 may also be arranged in a side by side relationship with the second exit opening 74 in a offset manner when the bottle 10 is viewed from the front. However, when the bottle 10 is viewed from the front, the second exit opening 74 is not directly behind the first exit opening 72. Thus, a left handed user and a right handed user handle the bottle 10 with a thumb on the front wall 12 of the bottle This orientation provides an ergonomically advantageous greater range of motion for the user than a vertically oriented bottle provides. In particular, lateral motion of the wrist is not constrained when using the bottle 10, especially when the bottle 10 is used to deliver the two liquids under the rim of a toilet bowl.

Other versions of the bottle 10 are also advantageous. For example, the bottle 10 may include a pair of two-piece closures, known in the art as "push-pull" closures, for sealing the contents within the two chamber bottle. Each two piece closure comprises an inner cap and an outer fitment. The inner cap has a hollow, reduced diameter spout which is closed at its top and has a circumferential sealing bead located below the top. The spout further includes at least one opening therein which is located between its closed top and the circumferential sealing bead. The outer fitment is hollow and has an upwardly extending, reduced diameter portion whose top is open. The fitment also has a peripheral sealing bead on the internal surface of its reduced diameter portion. To seal each chamber of the bottle and its contents, the inner cap is secured to an opening leading from the chamber. The fitment is then pushed into place over top of the inner cap so that the internally located sealing ring of the outer fitment is located below the externally located sealing bead of the inner cap, and the external surface of the uppermost portion of the spout of the inner cap comes into sealing engagement with the inner surface of the upwardly extending, reduced diameter portion of the external fitment. To dispense the contents of the chamber of the bottle, the fitment is pulled upwardly. This removes the spout of the inner cap from its sealing engagement with the inner surface of the reduced diameter portion of the fitment. The contents may then flow from the interior of the chamber, through the interior of the reduced diameter spout of the inner cap, through at least one opening in the spout, and finally through the open upper end of the fitment. One example "push-pull" closure construction can be found in U.S. Pat. No. 3,032,240 which is incorporated herein by reference.

EXAMPLES

The following examples serve to further illustrate the invention. The examples are not intended to limit the invention in any way.

Example 1

A two part cleaner suitable for cleaning a toilet bowl was prepared by mixing the following ingredients in Table 1 in separate containers (one designated Basic Side and one designated Acidic Side).

TABLE 1

| Basic Side | | Acidic Side | |
|---|---|---|---|
| Ingredient | Wt. % | Ingredient | Wt. % |
| Water | 94.9750 | Water | 89.9975 |
| Sodium Lauryl Ether Sulfate (Anionic Surfactant) | 0.0150 | Citric Acid | 5.0000 |
| Ethoxylated $C_{12}$–$C_{15}$ Alcohol (Non-Ionic Surfactant) | 0.0050 | Sulfamic Acid | 5.0000 |
| Fragrance | 0.0025 | Acid Blue #9 | 0.0025 |
| Ethyl Alcohol (Solvent) | 0.0025 | 50% Liquid Dye | |
| Sodium Bicarbonate | 5.0000 | | |
| TOTAL | 100.00 | TOTAL | 100.00 |

The sodium lauryl ether sulfate anionic surfactant used was a commercially available surfactant sold under the trade name "Empicol ESB 70F". The ethoxylated $C_{12}$–$C_{15}$ alcohol non-ionic surfactant used was a commercially available surfactant sold under the trade name "Lutensol A08".

Example 2

A two part cleaner suitable for cleaning a toilet bowl was prepared by mixing the following ingredients in Table 2 in separate containers (one designated Basic Side and one designated Acidic Side).

TABLE 2

| Basic Side | | Acidic Side | |
|---|---|---|---|
| Ingredient | Wt. % | Ingredient | Wt. % |
| Water | 92.7400 | Water | 83.9995 |
| Polydimethylsiloxane (Antifoam) | 0.0100 | Citric Acid | 5.0000 |
| Ethyl Alcohol (Solvent) | 0.2500 | Sulfamic Acid | 10.0000 |
| Sodium Bicarbonate | 6.5000 | Oxalic Acid | 0.5000 |
| Sodium Carbonate | 0.5000 | Acid Blue #9 | 0.0005 |
| | | 50% Liquid Dye | |
| | | Xanthan Gum (Thickener) | 0.1000 |
| | | Fragrance | 0.4000 |
| TOTAL | 100.00 | TOTAL | 100.00 |

The polydimethylsiloxane antifoam used was a commercially available silica filled polydimethylsiloxane sold under the trade name "SAG 10" by OSI Specialties. The xanthan gum used was commercially sold under the trade name "Kelzan ASX" by C. P. Kelco. When applied to a surface, an instantaneous fast breaking foam having audible fizzing was generated along with fragrancing in the vicinity of the surface.

Example 3

A two part cleaner suitable for cleaning a toilet bowl was prepared by mixing the following ingredients in Table 3 in separate containers (one designated Basic Side and one designated Acidic Side).

TABLE 3

| Basic Side | | Acidic Side | |
|---|---|---|---|
| Ingredient | Wt. % | Ingredient | Wt. % |
| Water | 90.1500 | Water | 84.3995 |
| Sodium Xylene Sulfonate (Anionic Hydrotrope) | 1.0000 | Citric Acid | 5.0000 |
| Ethoxylated Propoxylated Alcohol (Non-Ionic Surfactant) | 1.0000 | Sulfamic Acid | 10.0000 |
| Fragrance | 0.5000 | Oxalic Acid | 0.5000 |
| Hydroxy Ethyl Cellulose (Foam Stabilizer) | 0.0500 | Acid Blue #9 50% Liquid Dye | 0.0005 |
| Polydimethylsiloxane (Antifoam) | 0.2500 | Xanthan Gum (Thickener) | 0.1000 |
| Xanthan Gum (Thickener) | 0.0500 | | |
| Sodium Bicarbonate | 6.5000 | | |
| Sodium Carbonate | 0.5000 | | |
| TOTAL | 100.00 | TOTAL | 100.00 |

The sodium xylene sulfonate anionic hydrotrope used was commercially available under the trade name "Stepanate SXS" from Stepan Chemicals. The ethoxylated propoxylated alcohol non-ionic surfactant used was a commercially available surfactant sold under the trade name "Eumulgin L" by Cognis Corp. The polydimethylsiloxane antifoam used was a commercially available silica filled polydimethylsiloxane sold under the trade name "SAG 10" by OSI Specialties. The xanthan gum used was commercially sold under the trade name "Kelzan ASX" by C. P. Kelco. The hydroxy ethyl cellulose used was available under the trade name "Natrosol 250 HHR" from Hercules. When applied to a surface, an instantaneous fast breaking foam having audible fizzing was generated along with fragrancing in the vicinity of the surface.

Example 4

A two part cleaner suitable for cleaning a toilet bowl was prepared by mixing the following ingredients in Table 4 in separate containers (one designated Basic Side and one designated Acidic Side).

TABLE 4

| Basic Side | | Acidic Side | |
|---|---|---|---|
| Ingredient | Wt. % | Ingredient | Wt. % |
| Water | 91.1500 | Water | 84.3995 |
| 40% Sodium Xylene Sulfonate (Anionic Hydrotrope) | 1.0500 | Citric Acid | 5.0000 |
| Ethoxylated Propoxylated Alcohol (Non-Ionic Surfactant) | 0.3000 | Sulfamic Acid | 10.0000 |
| Fragrance (Antifoam) | 0.4000 | Oxalic Acid | 0.5000 |

TABLE 4-continued

| Basic Side | | Acidic Side | |
|---|---|---|---|
| Ingredient | Wt. % | Ingredient | Wt. % |
| Hydroxy Ethyl Cellulose (Foam Stabilizer) | 0.0500 | Acid Blue #9 50% Liquid Dye | 0.0005 |
| Xanthan Gum (Thickener) | 0.0500 | Xanthan Gum (Thickener) | 0.1000 |
| Sodium Bicarbonate | 6.5000 | | |
| Sodium Carbonate | 0.5000 | | |
| TOTAL | 100.00 | TOTAL | 100.00 |

The sodium xylene sulfonate anionic hydrotrope used was commercially available under the trade name "Stepanate SXS" from Stepan Chemicals. The ethoxylated propoxylated alcohol non-ionic surfactant used was a commercially available surfactant sold under the trade name "Eumulgin L" by Cognis Corp. The xanthan gum used was commercially sold under the trade name "Kelzan ASX" by C. P. Kelco. The hydroxy ethyl cellulose used was available under the trade name "Natrosol 250 HHR" from Hercules. When applied to a surface, an instantaneous fast breaking foam having audible fizzing was generated along with fragrancing in the vicinity of the surface.

Example 5

A two part cleaner suitable for cleaning a toilet bowl was prepared by mixing the following ingredients in Table 5 in separate containers (one designated Basic Side and one designated Acidic Side).

TABLE 5

| Basic Side | | Acidic Side | |
|---|---|---|---|
| Ingredient | Wt. % | Ingredient | Wt. % |
| Water | 89.3000 | Water | 84.3995 |
| 40% Sodium Xylene Sulfonate (Anionic Hydrotrope) | 1.5000 | Citric Acid | 5.0000 |
| Ethoxylated Alcohol | 0.2000 | Sulfamic Acid | 10.0000 |
| Fragrance | 0.4000 | Oxalic Acid | 0.5000 |
| Hydroxy Ethyl Cellulose (Foam Stabilizer) | 0.0500 | Acid Blue #9 50% Liquid Dye | 0.0005 |
| Dipropylene glycol n-butyl ether (Antifoam) | 1.5000 | Xanthan Gum (Thickener) | 0.1000 |
| Xanthan Gum (Thickener) | 0.0500 | | |
| Sodium Bicarbonate | 6.5000 | | |
| Sodium Carbonate | 0.5000 | | |
| TOTAL | 100.00 | TOTAL | 100.00 |

The sodium xylene sulfonate anionic hydrotrope used was commercially available under the trade name "Stepanate SXS" from Stepan Chemicals. The ethoxylated alcohol non-ionic surfactant used was a commercially available surfactant sold under the trade name "Lutensol A08" by BASF Corp. The xanthan gum used was commercially sold under the trade name "Kelzan ASX" by C. P. Kelco. The hydroxy ethyl cellulose used was available under the trade name "Natrosol 250 HHR" from Hercules. When applied to a surface, an instantaneous fast breaking foam having audible fizzing was generated along with fragrancing in the vicinity of the surface.

Therefore, it can be seen that the invention provides a two part cleaning composition having foaming characteristics that do not limit the beneficial mechanical cleaning action of the chemical reaction of the two part cleaner. The two part cleaning composition also has an improved balance of foaming characteristics and air freshening characteristics such that the cleaner is advantageous in cleaning hard surfaces and freshening the air in the vicinity of the hard surfaces. A two compartment container is also described for dispensing the two part cleaning composition wherein the two components are evenly dispensed from the container. The container also provides for ergonomically advantageous dispensing positions.

Although the present invention has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

INDUSTRIAL APPLICABILITY

The invention relates to a liquid two part cleaning composition for hard surfaces such as a toilet bowl, and a bottle for dispensing the liquid two part cleaning composition.

What is claimed is:

1. A cleaning composition comprising:

a first aqueous liquid comprising a base selected from the group consisting of carbonates, bicarbonates, sesquicarbonates, and mixtures thereof; and a second aqueous liquid comprising an acid selected from the group consisting of sulfuric acid, hydrochloric acid, phosphoric acid, nitric acid, boric acid, formic acid, acetic acid, malic acid, maleic acid, succinic acid, tartaric acid, lactic acid, glutaric acid, glycolic acid, fumaric acid, benzoic acid citric acid, sulfamic acid, oxalic acid, and mixtures thereof, wherein at least one of the first liquid and the second liquid includes about 0.001 percent by weight to about 4 percent by weight of a surfactant system consisting of all surfactants present in the first liquid or the second liquid in which the surfactant system is present, the percent by weight for the surfactant system being based on the total weight of the first liquid or the total weight of the second liquid in which the surfactant system is present, wherein at least one of the first liquid and the second liquid includes about 0.001 percent by weight to about 3 percent by weight of a foam inhibitor, the percent by weight for the foam inhibitor being based on the total weight of the first liquid or the total weight of the second liquid in Which the foam inhibitor is present, and wherein the first liquid and the second liquid are kept physically separated until use.

2. The cleaning composition of claim 1 wherein:

the foam inhibitor is selected from the group consisting of silicone materials, fragrance oils, glycol ethers, and mixtures thereof.

3. The cleaning composition of claim 1 wherein:

the foam inhibitor is selected from the group consisting of silicone materials.

4. The cleaning composition of claim 1 wherein:

the foam inhibitor is an alkylated polysiloxane material.

5. The cleaning composition of claim 1 wherein:

the foam inhibitor is polydimethylsiloxane.

6. The cleaning composition of claim 1 wherein:

the foam inhibitor is a fragrance oil.

7. The cleaning composition of claim 6 wherein:

a portion of the fragrance oil is not solubilized in the first liquid or the second liquid.

8. The cleaning composition of claim 6 wherein:

the fragrance oil is present in the first liquid or the second liquid in the range from about 0.001 percent by weight to about 1 percent by weight, the percent by weight for the fragrance being based on the total weight of the first liquid or the total weight of the second liquid in which the fragrance oil is present.

9. The cleaning composition of claim 1 wherein:

the foam inhibitor is a glycol ether.

10. The cleaning composition of claim 1 wherein:

the first liquid comprises about 2 percent by weight to about 20 percent by weight of the base based on the total weight of the first liquid.

11. The cleaning composition of claim 1 wherein:

the second liquid comprises about 5 percent by weight to about 25 percent by weight of the acid based on the total weight of the second liquid.

12. The cleaning composition of claim 1 wherein:

the base is selected from sodium carbonate, sodium bicarbonate and mixtures thereof.

13. The cleaning composition of claim 1 wherein.

the acid is selected from citric acid, sulfamic acid, oxalic acid, and mixtures thereof.

14. The cleaning composition of claim 1 wherein:

the acid is a mixture of citric acid, sulfamic acid, and oxalic acid.

15. The cleaning composition of claim 1 wherein:

at least one of the first liquid and the second liquid includes a thickener.

16. The cleaning composition of claim 1 wherein:

at least one of the first liquid and the second liquid includes a cellulosic foam stabilizer.

17. The cleaning composition of claim 16 wherein:

the foam stabilizer is hydroxy ethyl cellulose.

18. The cleaning composition of claim 1 wherein:

at least one of the first liquid and the second liquid in which the surfactant system is present further includes a hydrotrope.

19. The cleaning composition of claim 1 wherein:

at least one of the first liquid and the second liquid includes a solvent.

20. The cleaning composition of claim 1 wherein:

the surfactant system is selected from anionic surfactants, non-ionic surfactants and mixtures thereof.

21. The cleaning composition of claim 1 wherein:

the surfactant system is an ethoxylated alcohol.

22. The cleaning composition of claim 1 wherein:

the composition is a toilet cleaner.

23. A cleaning composition comprising:

a first aqueous liquid comprising a base selected from the group consisting of carbonates, bicarbonates, sesquicarbonates, and mixtures thereof; and a second aqueous liquid comprising an acid selected from the group consisting of sulfuric acid, hydrochloric acid, phosphoric acid, nitric acid, boric acid, formic acid, acetic acid, malic acid, maleic acid, succinic acid, tartaric acid, lactic acid, glutaric acid, glycolic acid, fumaric acid, benzoic acid, citric acid, sulfamic acid, oxalic acid, and mixtures thereof, wherein at least one of the first liquid and the second liquid includes about 0.001 percent by weight to about 4 percent by weight of a surfactant system consisting of all surfactants present in the first liquid or the second liquid in which the surfactant system is present, the percent by weight for the surfactant system being based on the total weight of the first liquid or the total weight of the second liquid in which the surfactant system is present, wherein at least one of the first liquid and the second liquid includes about 0.001 percent by weight to about 1 percent by weight of a silicone foam inhibitor, the percent by weight for the foam inhibitor being based on the total weight of the first liquid or the total weight of the second liquid in which the foam inhibitor is present, and wherein the first liquid and the second liquid are kept physically separated until use.

24. The cleaning composition of claim 23 wherein:

at least one of the first liquid and the second liquid in which the surfactant system is present includes about 0.001 percent by weight to about 1 percent by weight of a fragrance comprising at least one oil, the percent by weight for the fragrance being based on the total weight of the first liquid or the total weight of the second liquid in which the fragrance is present.

25. The cleaning composition of claim 23 wherein:

the base is selected from the group consisting of sodium carbonate, sodium bicarbonate, and mixtures thereof.

26. The cleaning composition of claim 25 wherein:

the first liquid comprises about 2 percent by weight to about 20 percent by weight of the base based on the total weight of the first liquid.

27. The cleaning composition of claim 26 wherein:

the base is a mixture of sodium carbonate and sodium bicarbonate.

28. The cleaning composition of claim 23 wherein:

the acid is selected from the group consisting of citric acid, sulfamic acid, oxalic acid, and mixtures thereof.

29. The cleaning composition of claim 28 wherein:

the second liquid comprises about 5 percent by weight to about 25 percent by weight of the acid based on the total weight of the second liquid.

30. The cleaning composition of claim 29 wherein:

the acid is a mixture of citric acid, sulfamic acid and oxalic acid.

31. The cleaning composition of claim 23 wherein:

the surfactant system is selected from anionic surfactants, non-ionic surfactants and mixtures thereof.

32. The cleaning composition of claim 23 wherein:

the surfactant system is an ethoxylated alcohol.

33. The cleaning composition of claim 23 wherein:

at least one of the first liquid and the second liquid includes a thickener.

34. The cleaning composition of claim 23 wherein:

at least one of the first liquid and the second liquid includes a cellulosic foam stabilizer.

35. The cleaning composition of claim 34 wherein:

the foam stabilizer is hydroxy ethyl cellulose.

36. The cleaning composition of claim 23 wherein:

at least one of the first liquid and the second liquid in which the surfactant system is present further includes a hydrotrope.

37. The cleaning composition of claim 23 wherein:

the composition is a toilet cleaner.

38. A cleaning composition comprising:

a first aqueous liquid comprising a base selected from the group consisting of carbonates, bicarbonates, sesquicarbonates, and mixtures thereof; and a second aqueous liquid comprising an acid selected from the group consisting of sulfuric acid, hydrochloric acid, phosphoric acid, nitric acid, boric acid, formic acid, acetic acid, malic acid, maleic acid, succinic acid, tartaric acid, lactic acid, glutaric acid, glycolic acid, fumaric acid, benzoic acid, citric acid, sulfamic acid, oxalic acid, and mixtures thereof, wherein at least one of the first liquid and the second liquid includes about 0.001 percent by weight to about 4 percent by weight of a surfactant system consisting of all surfactants present in the first liquid or the second liquid in which the surfactant system is present, the percent by weight for the surfactant system being based on the total weight of the first liquid or the total weight of the second liquid in which the surfactant system is present, wherein at least one of the first liquid and the second liquid includes about 0.001 percent by weight to about 1 percent by weight of a silicone foam inhibitor, the percent by weight for the foam inhibitor being based on the total weight of the first liquid or the total weight of the second liquid in which the foam inhibitor is present, wherein at least one of the first liquid and the second liquid in which the surfactant system is present includes about 0.001 percent by weight to about 1 percent by weight of a fragrance comprising at least one oil, the percent by weight for the fragrance being based on the total weight of the first liquid or the total weight of the second liquid in which the fragrance is present, and wherein the first liquid and the second liquid are kept physically separated until use.

39. The cleaning composition of claim 38 wherein:

the composition is a toilet cleaner.

* * * * *